US012318047B2

(12) United States Patent
Montgomery et al.

(10) Patent No.: US 12,318,047 B2
(45) Date of Patent: Jun. 3, 2025

(54) BRACKET SYSTEM AND METHOD

(71) Applicant: Boom Hardware LLC, North Salt Lake, UT (US)

(72) Inventors: Steven Montgomery, North Salt Lake, UT (US); Scott Montgomery, Idaho Falls, ID (US); Michelle O'Neal, North Salt Lake, UT (US)

(73) Assignee: Boom Hardware LLC, North Salt Lake, UT (US)

( * ) Notice: Subject to any disclaimer, the term of this patent is extended or adjusted under 35 U.S.C. 154(b) by 296 days.

(21) Appl. No.: 17/839,375

(22) Filed: Jun. 13, 2022

(65) Prior Publication Data

US 2023/0397779 A1 Dec. 14, 2023

(51) Int. Cl.
*A47B 96/06* (2006.01)
*A47K 10/10* (2006.01)

(52) U.S. Cl.
CPC ..... *A47K 10/10* (2013.01); *A47B 96/06* (2013.01)

(58) Field of Classification Search
None
See application file for complete search history.

(56) References Cited

U.S. PATENT DOCUMENTS

| | | | | |
|---|---|---|---|---|
| 1,838,935 A | | 12/1931 | Fixsen | |
| 4,432,504 A | | 2/1984 | Pace | |
| 5,664,751 A | | 9/1997 | Lan | |
| 5,875,903 A | * | 3/1999 | Chen | A47K 10/10 211/105.1 |
| 6,430,759 B1 | * | 8/2002 | Beltran | A47K 10/10 248/251 |
| 6,595,478 B2 | | 7/2003 | Lee | |
| 6,651,830 B2 | * | 11/2003 | Pan | A47K 10/10 248/251 |
| 7,111,336 B1 | | 9/2006 | Lai | |

(Continued)

FOREIGN PATENT DOCUMENTS

| | | | |
|---|---|---|---|
| CN | 201205252 | Y | 3/2009 |
| FR | 2623575 | A1 | 5/1989 |
| JP | 6501860 | B2 | 4/2019 |

OTHER PUBLICATIONS

PCT/US2023/023607 filed May 25, 2022 International Search Report and Written Opinion dated Aug. 28, 2023.

(Continued)

*Primary Examiner* — Steven M Marsh
(74) *Attorney, Agent, or Firm* — Rutan & Tucker LLP

(57) ABSTRACT

Embodiments disclosed herein are directed to a bracket system for coupling to a wall, the wall having an exterior layer supported by a support beam. The bracket system includes an anchor having a flange, a stud portion extending rearwards, and a block portion extending frontwards. The stud portion extends through the exterior layer to engage the support beam directly. The flange can engage a front surface of the exterior layer. An anchor screw can extend through an anchor screw hole to secure the anchor to the support beam. A bracket can include a socket configured to slidably engage the block portion. When the block portion is engaged with the socket, a bolt hole of the block portion can align with a bolt hole of the bracket. A bolt can extend transversely through the bolt holes to secure the bracket to the anchor.

20 Claims, 9 Drawing Sheets

(56) References Cited

U.S. PATENT DOCUMENTS

| | | | | |
|---|---|---|---|---|
| 7,967,522 | B2 * | 6/2011 | Goad | E04F 11/1808 403/205 |
| 8,342,771 | B2 * | 1/2013 | Goad | E04F 11/1804 403/205 |
| 8,382,051 | B2 * | 2/2013 | Smith | A47K 10/10 248/221.11 |
| 8,387,931 | B2 | 3/2013 | Forrest | |
| 8,430,369 | B2 | 4/2013 | Hsu et al. | |
| 9,089,245 | B1 | 7/2015 | Pamphilis | |
| 9,715,960 | B2 | 7/2017 | Chaizy | |
| 9,955,827 | B2 | 5/2018 | Morris | |
| 11,006,786 | B1 | 5/2021 | Daniels | |
| 11,058,245 | B2 | 7/2021 | Wright et al. | |
| 11,643,820 | B2 * | 5/2023 | Kuo | E04F 11/1808 248/251 |
| 2002/0104946 | A1 * | 8/2002 | Lai | A47K 10/04 248/224.7 |
| 2003/0099525 | A1 | 5/2003 | Michels | |
| 2006/0022098 | A1 | 2/2006 | De Backer | |
| 2008/0048079 | A1 | 2/2008 | Albritton et al. | |
| 2009/0205123 | A1 | 8/2009 | Forrest | |
| 2009/0206220 | A1 | 8/2009 | Forrest et al. | |
| 2009/0242713 | A1 * | 10/2009 | Lowe | A47K 10/38 248/222.13 |
| 2011/0150600 | A1 | 6/2011 | Spencer, Jr. et al. | |
| 2014/0271031 | A1 | 9/2014 | Agri et al. | |
| 2021/0137326 | A1 | 5/2021 | Edwards et al. | |

OTHER PUBLICATIONS

U.S. Appl. No. 18/131,794, filed Apr. 6, 2023 Non-Final Office Action dated Mar. 13, 2025.

* cited by examiner

BRACKET SYSTEM AND METHOD

SUMMARY

Briefly summarized, embodiments of the present invention are directed to a bracket system for coupling to a wall, the wall having an exterior layer supported by a support beam. The bracket system includes an anchor having a flange, a stud portion extending rearwards, and a block portion extending frontwards. The stud portion extends through the exterior layer of the wall to directly engage the support beam. The flange can engage a front surface of the exterior layer of the wall to further stabilize the anchor. An anchor screw can extend through an anchor screw hole to secure the anchor to the support beam. A bracket can include a socket configured to slidably engage the block portion. When the block portion is engaged with the socket, a bolt hole of the block portion can align with a bolt hole of the bracket. A bolt can extend transversely through the bolt holes to secure the bracket to the anchor.

Disclosed herein is a bracket system for coupling to a wall, the wall including exterior layer and a support beam, the bracket system including, an anchor having, a flange extending over a frontal plane, parallel with a surface of the wall and defining a front surface and a rear surface, a stud portion extending from the rear surface of the flange and defining a stud-engaging surface configured to extend through the exterior layer and engage the support beam, and a block portion extending from the front surface of the flange, and a bracket having, a base defining a socket configured to slidably engage the block portion and secured thereto.

In some embodiments, the bracket system further includes an anchor screw hole extending longitudinally between a front surface of the anchor and the stud-engaging surface and including a countersunk portion communicating with the front surface of the anchor.

In some embodiments, the bracket system further includes a bolt hole extending transversely through a portion of the bracket and through the block portion, the bolt hole extending between a plane defined by the countersunk portion and a plane defined by the stud-engaging surface.

In some embodiments, the bracket system further includes a post extending along a longitudinal axis and including a retaining structure disposed at a front end of the post, the retaining structure defining a recess extending along a lateral axis.

In some embodiments, the recess is configured to receive a portion of a towel rod therein.

In some embodiments, a rear surface of the base includes a flange recess defining a diameter and a thickness equal to, or slightly larger than, a flange diameter and thickness, respectively, and configured to slidably engage the flange when the bracket is engaged with the anchor.

In some embodiments, the block portion defines a rectangular cross-sectional shape along a frontal plane, and the stud portion defines a circular cross-sectional shape along the frontal plane.

In some embodiments, the bracket system further includes one or both of a spike structure and a rim, the spike structure extending rearwards from a center point of the stud-engaging surface, and the rim extending rearwards from a perimeter of the stud-engaging surface, each of the spike structure and the rim configured to indent a front surface of the wall.

In some embodiments, the bracket system further includes a jig system, including one or more footings having a body defining a block portion aperture and a channel, the block portion aperture extending longitudinally and configured to slidably engage the block portion of the anchor, and the channel extending along a lateral axis.

In some embodiments, the bracket system further includes a bar defining an outer diameter that is equal to, or slightly smaller than, an inner diameter of the channel of the footing and configured to slidably engage the channel.

In some embodiments, the footing further includes a support screw slot extending longitudinally and configured to align with a support screw aperture extending through the flange when the block portion is engaged with the block portion aperture of the footing.

Also disclosed is a method of attaching a bracket system to a wall having an exterior layer supported by a support beam, the method including, extending a stud portion of an anchor through the exterior layer to contact the support beam, extending an anchor screw through the anchor to secure the anchor to the support beam, slidably engaging a socket of a bracket with a block portion of the anchor, and threadably engaging a bolt through a portion of the base and through the block portion of the anchor between a plane defined by the anchor screw head and a surface of the support beam.

In some embodiments, the anchor further includes a flange extending along a frontal plane between the stud portion and the block portion, a rear surface of the flange engaging a front surface of the exterior layer of the wall.

In some embodiments, the method further includes aligning a transverse axis of the anchor with a vertical axis and securing the anchor in place using a support screw extending through the flange.

In some embodiments, the stud portion defines a circular cross-sectional shape and the block portion defines a rectangular cross-sectional shape.

In some embodiments, the method further includes aligning a stud-engaging surface of the stud portion with a front surface of the exterior layer and with a vertical center line of the support beam, and pressing the anchor against the exterior layer, and indenting the exterior layer using one or both of a spike and a rim extending from the stud-engaging surface to indicate a position to form a hole through which the stud portion extends to contact the support beam.

In some embodiments, the method further includes engaging a first footing of a jig system with the block portion of a first anchor, engaging a block portion of a second anchor with a second footing, slidably engaging the first footing and the second footing with a bar, sliding the second footing relative to the first footing along a lateral axis, and aligning the second anchor with a second support beam.

In some embodiments, one or both of the first footing and the second footing includes a block portion aperture extending between a front surface and a rear surface and slidably engaging the block portion.

In some embodiments, the method further includes securing the first footing to the first anchor by extending a support screw through a support screw slot and through a support screw aperture disposed in a flange of the anchor.

In some embodiments, the method further includes engaging a rod between a retaining structure of the first bracket and a retaining structure of the second bracket to form a towel rail.

DRAWINGS

A more particular description of the present disclosure will be rendered by reference to specific embodiments thereof that are illustrated in the appended drawings. It is appreciated that these drawings depict only typical embodiments of the invention and are therefore not to be considered limiting of its scope. Example embodiments of the invention will be described and explained with additional specificity and detail through the use of the accompanying drawings in which.

DESCRIPTION

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein. It is understood that the drawings are diagrammatic and schematic representations of exemplary embodiments of the invention, and are neither limiting nor necessarily drawn to scale.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise. Also, the words "including," "has," and "having," as used herein, including the claims, shall have the same meaning as the word "comprising."

In the following description, the terms "or" and "and/or" as used herein are to be interpreted as inclusive or meaning any one or any combination. As an example, "A, B or C" or "A, B and/or C" mean "any of the following, A, B, C, A and B, A and C, B and C, A, B and C." An exception to this definition will occur only when a combination of elements, components, functions, steps or acts are in some way inherently mutually exclusive.

Figure 1:
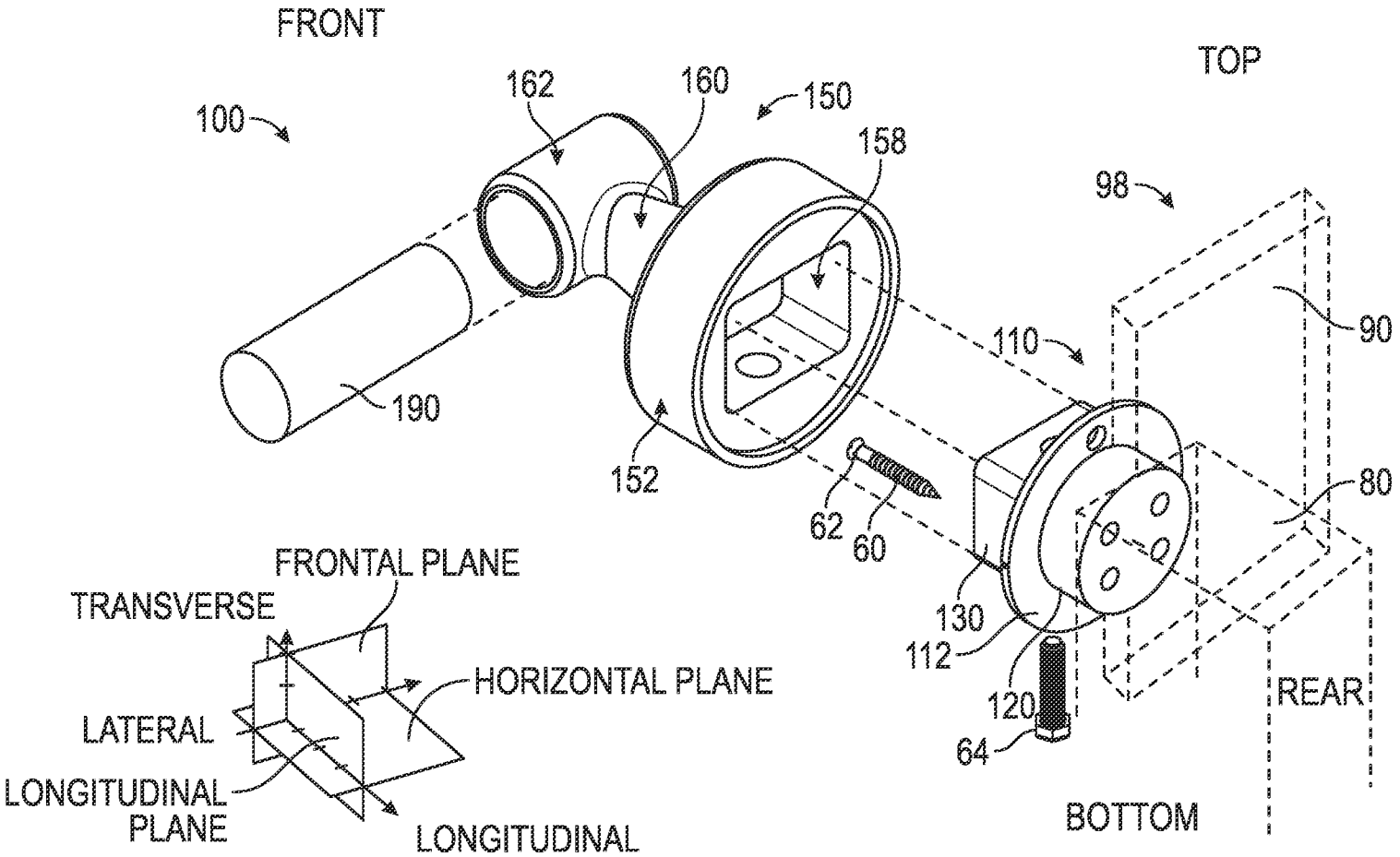
FIG. 1 shows an exploded view of a bracket system including an anchor and a bracket, in accordance with embodiments disclosed herein.

To assist in the description of embodiments described herein, and as shown in FIG. 1, a longitudinal axis extends between the front side and the rear side of the bracket system. A lateral axis extends normal to the longitudinal axis between the left side and the right side of the bracket system, and a transverse axis extends normal to both the longitudinal and lateral axes between a top side and a bottom side. A frontal plane is defined by the lateral and transverse axes. A horizontal plane is defined by the lateral and longitudinal axes. A longitudinal plane is defined by the longitudinal and transverse axes.

Unless defined otherwise, all technical and scientific terms used herein have the same meaning as commonly understood by those of ordinary skill in the art.

FIG. 1 shows a bracket system ("system") 100 configured to be secured to a wall and generally including an anchor 110 and a bracket 150. Optionally, the system 100 can further include a rod 190, ring (not shown), or similar structure coupled to the bracket as described in more detail herein. As shown in FIG. 1, the system 100 is shown in exploded perspective view from a rear side, where a rear side of the system 100 engages a wall 98. An exterior layer 90 and a supporting beam 80 of the wall 98 are shown in cut-away, wire frame for ease of explanation.

In an embodiment, the anchor 110 includes a flange 112 extending over a frontal plane, a first portion, or stud portion 120 extending rearwards from the flange 112, and a second portion, or block portion 130, extending frontwards from the flange 112. In an embodiment, the stud portion 120 is configured to extend through an exterior layer 90 of the wall 98, e.g. a drywall layer, or the like, and can engage directly with a stud or similar supporting beam 80 disposed behind the exterior layer 90. The bracket 150 can then engage a block portion 130 of the anchor 110, opposite the stud portion 120, and can be securely coupled thereto. Optionally, the bracket 150 can further engage a rod 190, ring (not shown), or similar structure.

Advantageously, the bracket system 100 can support a towel rod, towel ring, handle, shelving support, picture hanger, TV mount, exercise equipment, pull up bar, shower curtain rods, drapes, or similar structures for supporting, attaching, and/or suspending structures and/or utensils (e.g. towels etc.) from the wall. Further, since the bracket system 100 extends through the exterior layer to engage directed with a supporting beam 80, the bracket system 100 can support an increased weight and mitigate the system 100 from being forcibly removed from the wall 98 should additional weight been added. For example, where brackets are attached only to an exterior layer of drywall, the load capacity is limited by the strength of the drywall, e.g. approximately 50 lbs. Where brackets are attached to a front surface of the drywall exterior layer 90 and to the supporting beam 80 behind, greater load capacities can be achieved.

However, load capacities are still limited since the bracket is resting on the exterior layer of drywall, which can be compressed and crushed leading to failure of the bracket system. Advantageously, embodiments of the bracket system 100 disclosed herein extends through the surface drywall layer 90 to engage directly with the supporting beam 80 and, as such, can support greater load capacities.

Figure 2B:
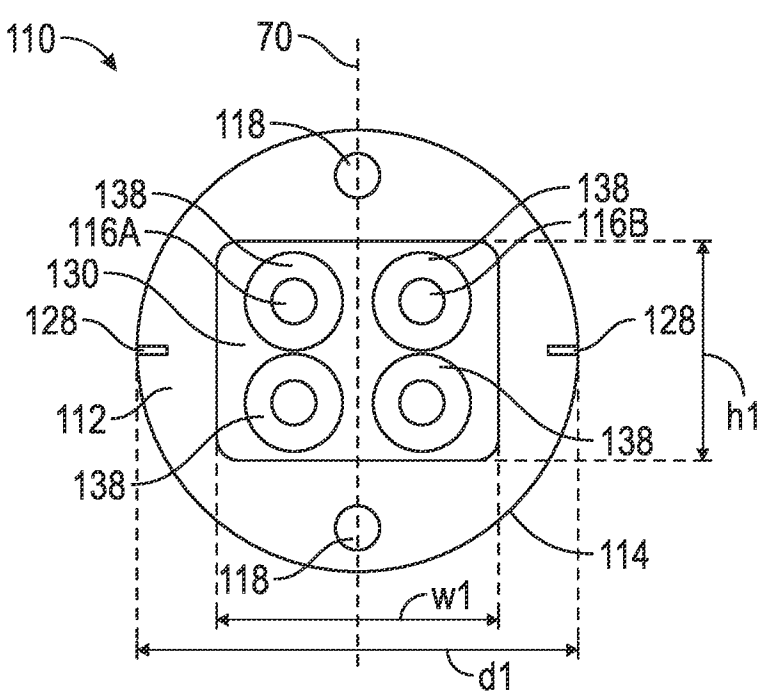
FIG. 2B shows a front view of an anchor, in accordance with embodiments disclosed herein.
Figure 2A:
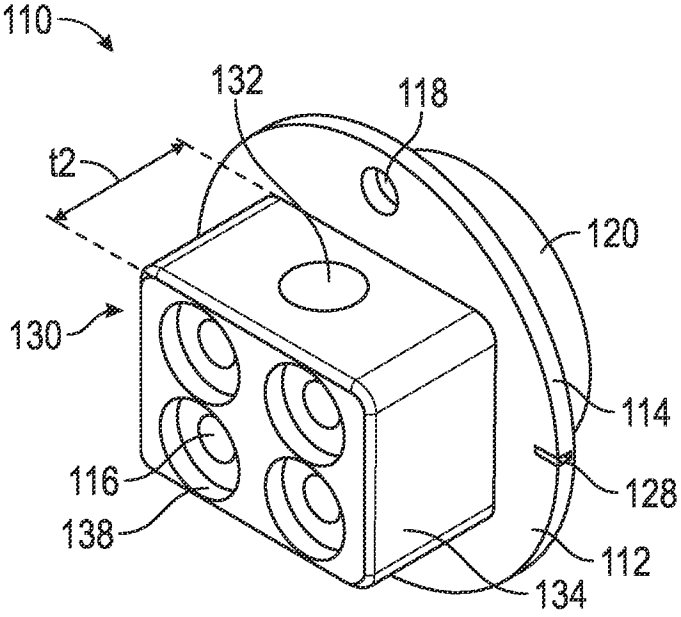
FIG. 2A shows a perspective front view of an anchor, in accordance with embodiments disclosed herein.
Figure 2D:
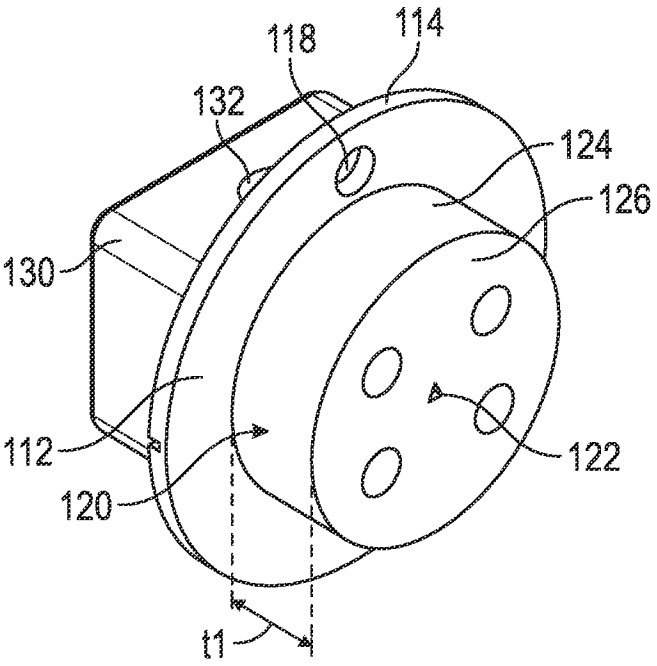
FIG. 2D shows a perspective rear view of an anchor, in accordance with embodiments disclosed herein.
Figure 2C:
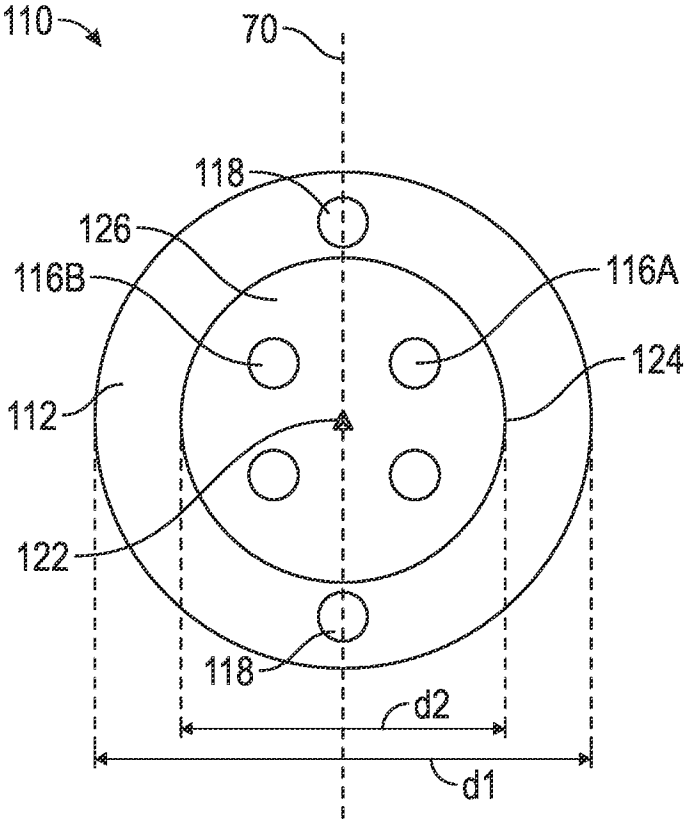
FIG. 2C shows a rear view of an anchor, in accordance with embodiments disclosed herein.

FIGS. 2A-2D show various views of the anchor 110 of the system 100. FIG. 2A shows a front side perspective view of the anchor. FIG. 2B shows a front side view, and FIG. 2C shows a rear side view. FIG. 2D shows a perspective rear view of the anchor 110. The anchor 110 can include a flange 112 extending over a frontal plane and defining an outer perimeter 114. As shown the outer perimeter 114 can define a substantially circular shape, however it will be appreciated that other regular or irregular, closed curve shapes are also contemplated. In an embodiment, the flange 112 can define a first diameter (d1) of between 1 inch. and 4 inch. However, it will be appreciated the greater or lesser diameters of the first diameter (d1) are also contemplated. In an embodiment, the first diameter (d1) can be 2.3 inch.

The anchor 110 can further include a stud portion 120 extending rearwards from a rear side of the flange 112, and a block portion 130 extending frontwards from a front surface of the flange 112. In an embodiment, the stud portion 120 can define a substantially circular outer perimeter 124, however it will be appreciated that other regular or irregular, closed curve perimeter shapes are also contemplated. In an embodiment, the outer perimeter 124 of the stud portion 120 can define a second diameter (d2) that is less than the first diameter (d1). In an embodiment, the second diameter (d2) can be between 0.5 inch. and 3 inch. However, it will be appreciated the greater or lesser diameters of the second diameter (d2) are also contemplated. In an embodiment, the second diameter (d2) can be 1.5 inch.

In an embodiment, as shown in FIG. 2D, the stud portion 120 can define a first thickness (t1). As used herein, the first thickness (t1) can be defined as a distance between a rear-most surface of the stud portion 120 and a rear-most surface of the flange 112. In an embodiment, the first thickness (t1) can be between 0.25 inch. and 1 inch. However, it will be appreciated the greater or lesser thicknesses are also contemplated. In an embodiment, the first thickness (t1) can be 0.5 inch. In an embodiment, the first thickness (t1) can be substantially equal to a thickness of the exterior layer 90 of the wall 98.

In an embodiment, the block portion 130 can define a substantially rectangular outer perimeter 134, however it will be appreciated that other regular or irregular, closed curve perimeter shapes are also contemplated, such as square, hexagonal, circular, oval, elliptical, or the like. In an embodiment, the outer perimeter 134 of the block portion 130 can define a first width (w1) and a first height (h1). In an embodiment, one or both of the first width (w1) and the first height (h1) can be between 0.5 inch. and 3 inch. However, it will be appreciated the greater or lesser widths and/or heights are also contemplated. In an embodiment, the first width (w1) can be 1.48 inch., and the first height (h1) can be 1.13 inch.

In an embodiment, as shown in FIG. 2A, the block portion 130 can define a second thickness (t2). As used herein, the second thickness (t2) can be defined as a distance between a front-most surface of the block portion 130 and a front-most surface of the flange 112. In an embodiment, the second thickness (t2) can be between 0.25 inch. and 1 inch. However, it will be appreciated the greater or lesser thicknesses are also contemplated. In an embodiment, the second thickness (t2) can be 0.8 inch.

In an embodiment, the anchor 110 can include one or more anchor screw-holes 116 extending along a longitudinal axis between a front surface through to the rear surface of the anchor 110, e.g. between a front surface of the block portion 130 and a rear surface of the stud portion 120. As shown, the anchor 110 can include four anchor screw-holes 116, however, greater or lesser numbers of anchor screw-holes 116 are also contemplated. In an embodiment, the anchor 110 can include at least a first anchor screw-hole 116A disposed on a first side of a central vertical axis 70 and at least a second anchor screw-hole 116B disposed on a second side of a central vertical axis 70, opposite the first side. In an embodiment, one or more anchor screw-holes 116 can include a countersunk portion 138 at a front end of the anchor screw-holes 116 and configured to receive a screw head 62 of the anchor screw 60 therein. Exemplary anchor screws can include RSS 10 screws, however, it will be a appreciated that this is not intended to be limiting and that other screws, or similar suitable fastenings, are also contemplated. A longitudinal depth of the countersunk portion 138 can be equal to or greater than a longitudinal height of the anchor screw head 62. Advantageously, the countersunk portion 138 can mitigate the anchor screw 60 from abutting against a portion of the bracket 150, when the bracket engages the anchor 110, as described in more detail herein.

In an embodiment, the block portion 130 can further include a bolt hole 132 extending along a transverse axis between a bottom side of the block portion 130 and a top side of the block portion 130. An inner diameter of the bolt hole 132 can be equal to or greater than an outer diameter of a bolt 64 extending therethrough. In an embodiment, the bolt hole 132 can extend along an axis disposed between a frontal plane defined by a countersunk portion 138 of the anchor screw-hole 116, and a frontal plane defined by a rear-most surface of the anchor 110. In an embodiment, the bolt hole 132 extends along an axis disposed between a frontal plane defined by a countersunk portion 138 of the anchor screw-hole 116, and a frontal plane defined by a front surface of the flange 112.

It is important to note that the bolt 64 extending through the bolt hole 132 extends between two or more anchor screws 60 extending through the anchor screw-holes 116. As such the fasteners of the bolt 64 and anchor screw 60 interlock providing increased strength to the system 100. The interlocking configuration of the fasteners allows the portions of the anchor 110 disposed therebetween to also rely on compressive strength, sheer strength, and torsional strength, in addition to the tensile strength of the material of the anchor 110. By contrast, other bracket systems that do not have an interlocking fastener configuration can only rely on tensile strength.

In an embodiment, the flange 112 can include one or more guide notches 128, markings, alphanumeric symbols, or the like disposed along an edge of the flange 112 and on a front surface thereof. The guide notches 128 can be positioned along the edge of the flange 112 to indicate one or more measurements. For example, one or more guide notches 128 can be positioned at a 90° and a 270° position about the central longitudinal axis to indicate a lateral axis or horizontal plane. Similarly, one or more guide notches 128 can be positioned at a 0° and a 180° position about the central longitudinal axis to indicate a transverse axis or longitudinal plane. As will be appreciated, other guide notches 128 can be positioned at other angles about the longitudinal axis of between 1° and 360°. Advantageously, the guide notches 128 can facilitate aligning the anchor 110 with various guide marks, plumb lines, or the like.

Figure 3B:
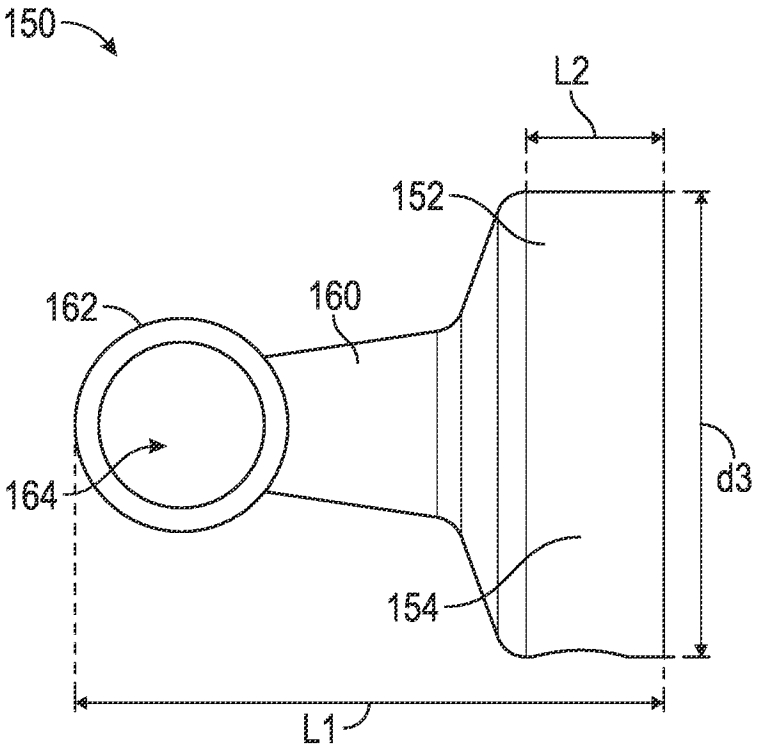
FIG. 3B shows a side view of a bracket, in accordance with embodiments disclosed herein.
Figure 3A:
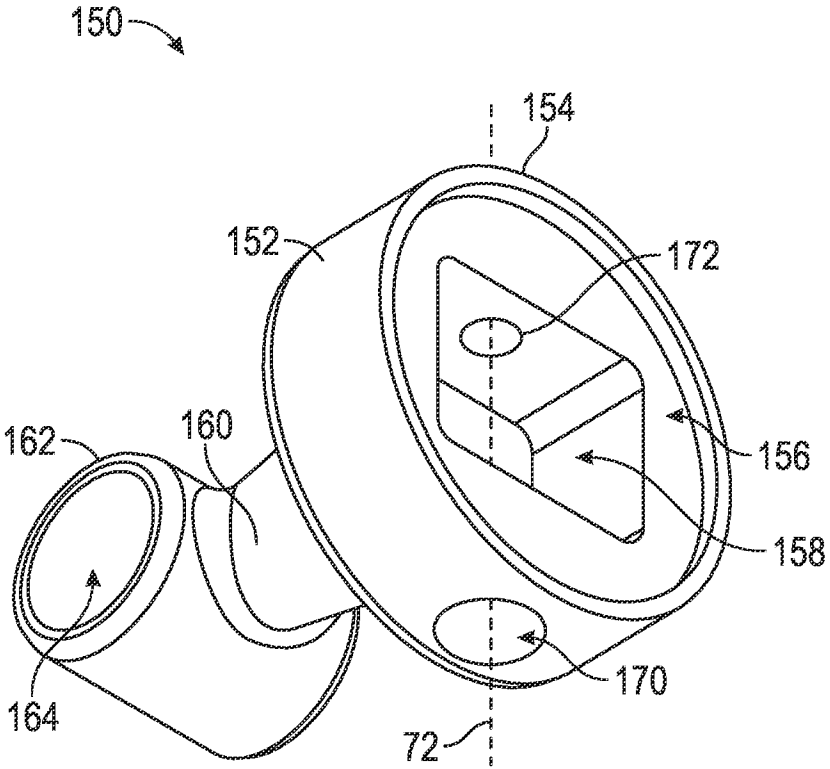
FIG. 3A shows a perspective rear view of a bracket, in accordance with embodiments disclosed herein.
Figure 3D:
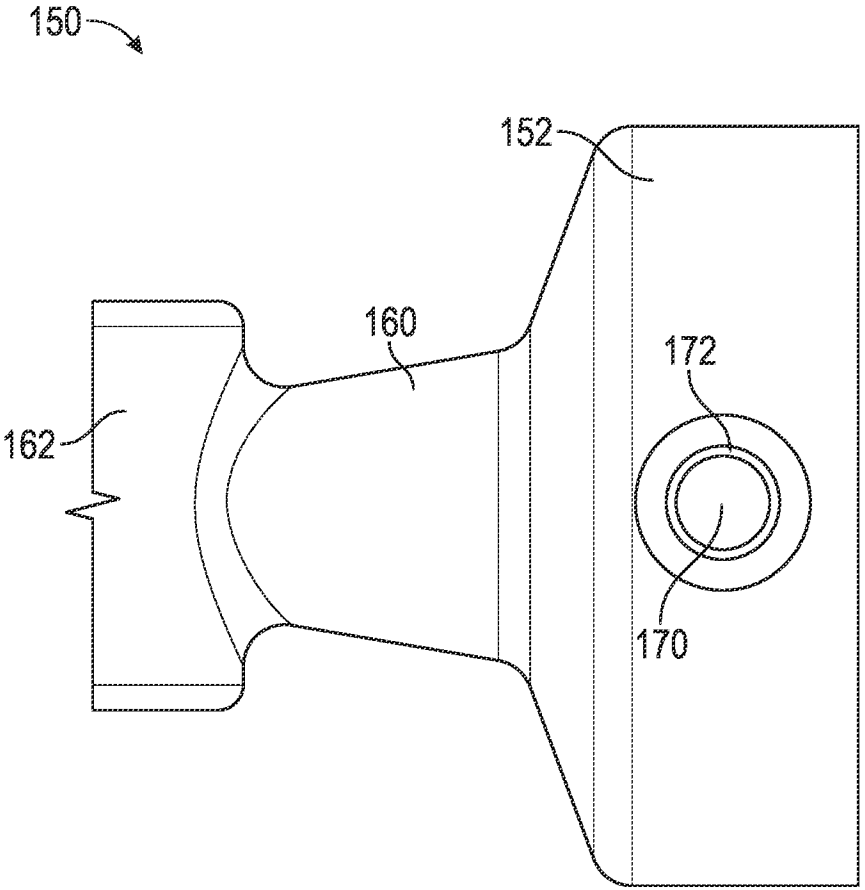
FIG. 3D shows an underside view of a bracket, in accordance with embodiments disclosed herein.
Figure 3C:
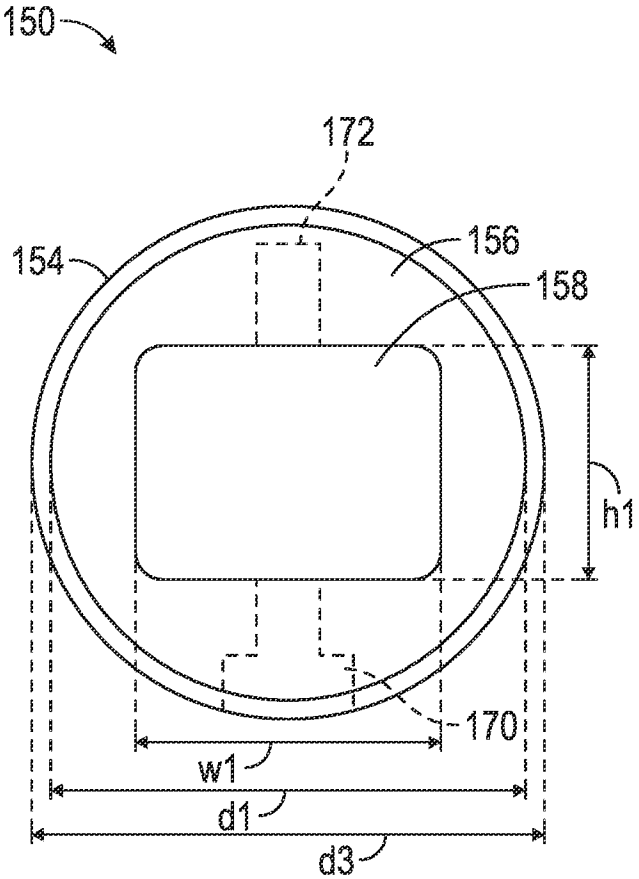
FIG. 3C shows a rear view of a bracket, in accordance with embodiments disclosed herein.
Figure 5B:
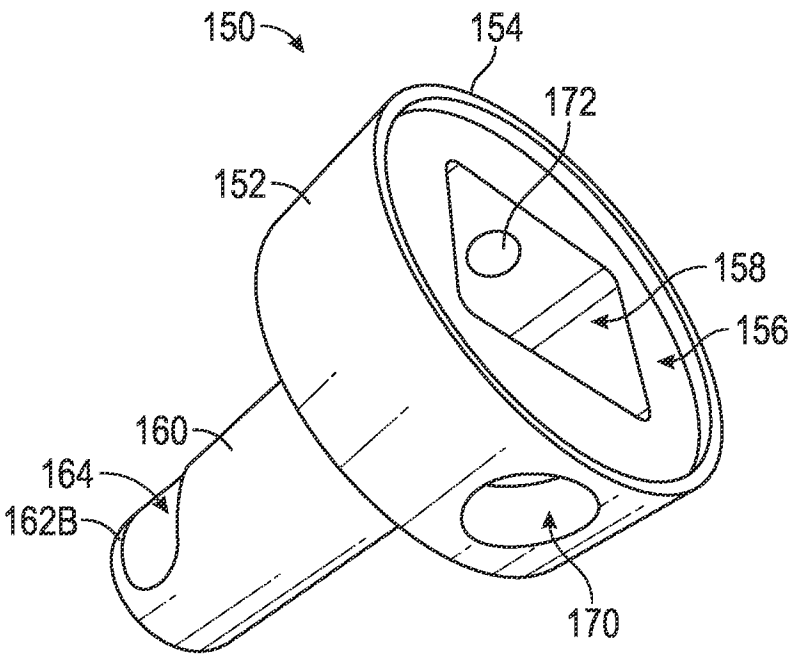
FIG. 5B shows an underside perspective view of a bracket, in accordance with embodiments disclosed herein.
Figure 5A:
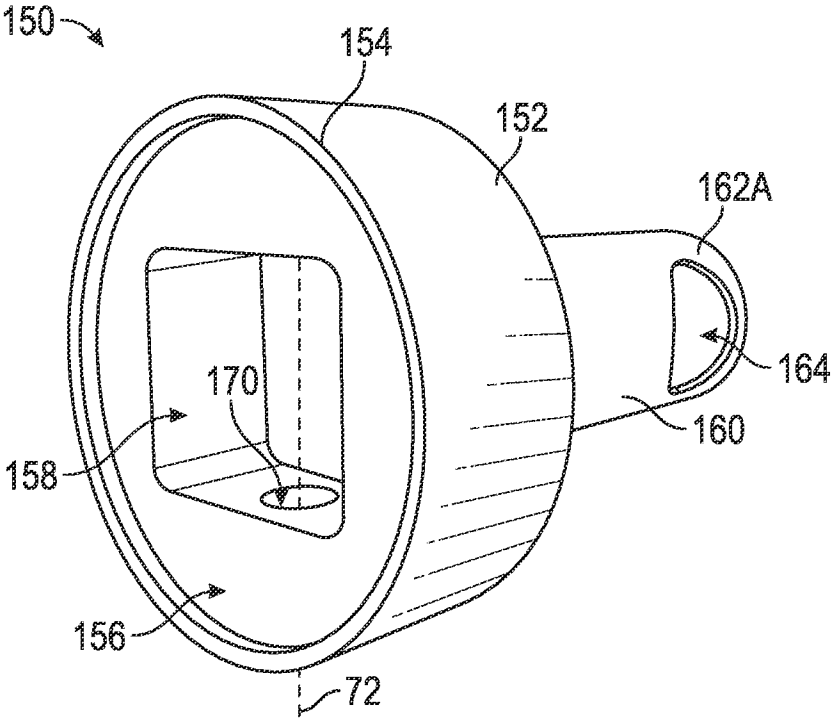
FIG. 5A shows a rear perspective view of a bracket, in accordance with embodiments disclosed herein.

FIGS. 3A-3D and 5A-5B shows various views of a bracket 150. FIG. 3A shows a perspective, rear-side view of the bracket 150. FIG. 3B shows a lateral-side view. FIG. 3C shows a rear-side view of the bracket 150. FIG. 3D shows a bottom-side view. FIG. 5A shows a rear perspective view. FIG. 5B shows an underside perspective view. The bracket 150 can generally include a base 152 disposed rearwards and can include a post 160 extending forwards therefrom, along a longitudinal axis. In an embodiment, the post 160 can include a retaining structure 162 disposed at a front-side end of the post 160, opposite from the base 152, and configured to receive a portion of a rod, a ring, or similar structure, therein.

In an embodiment, as shown in FIGS. 1, 3A-3B, and 5A-5B, the retaining structure 162 can define a substantially cylindrical recess 164 configured to receive an end portion of a rod 190 such as a towel rod, handle, or the like. In an embodiment, a central axis of the recess 164 can extend along a lateral axis, however, it will be appreciated that the central axis of the recess 164 can extend along other axes, or at angles thereto, without limitation. An end portion of the rod 190 can extend into the recess 164 and abut against an end wall of the recess 164. In an embodiment, as shown in FIGS. 5A-5B, a second bracket system 100 can secure an opposite end of the rod 190 in like manner to secure the rod 190 in place for use as a towel rail, handle, or the like, as described in more detail herein. In an embodiment, the user can trip the rod 190 to a preferred length and position the rod 190 between a first bracket system and a second bracket system, as described in more detail herein.

In an embodiment, a cross-sectional shape of the recess 164 (longitudinal plane) can define a circular shape, however it will be appreciated that other regular or irregular, closed curve shapes are also contemplated such as elliptical, oval, square, rectangular, hexagonal, or the like. In an embodiment, as shown in FIG. 3B, the bracket 150 can extend along a longitudinal axis by a first length (L1). In an embodiment, the first length (L1) can extend between 1 inch. and 10 inch. In an embodiment, the first length (L1) can extend between 3 inch. and 4 inch. However, it will be appreciated the greater or lesser lengths are contemplated.

In an embodiment, the base 152 can extend over a frontal plane and define an outer perimeter 154. In an embodiment, the outer perimeter 154 can define a circular shape (frontal plane). However, it will be appreciated that other regular or irregular, closed curve shapes are also contemplated such as elliptical, oval, square, rectangular, hexagonal, or the like. In an embodiment, the outer perimeter 154 of the base 152 can define a third diameter (d3) that is equal to, or larger than, the first diameter (d1) of the flange 112. In an embodiment, the third diameter (d3) can extend between 2 inch. and 5 inch. In an embodiment, the third diameter (d3) can extend 2.5 inch. However, it will be appreciated the greater or lesser diameters are contemplated.

In an embodiment, a rear surface of the base 152 can define a flange recess 156 configured to receive the flange 112, or a portion thereof, therein. As such, the flange recess 156 can define a similar shape matching that of the outer perimeter 114 of the flange 112, e.g. a circular shape. A diameter of the flange recess 156 can be equal to or slightly larger than the first diameter (d1) of the flange 112, such that the flange 112 can slidably engage the flange recess 156 along the longitudinal axis. Similarly, a depth of the flange recess 156, extending over the longitudinal axis, can be equal to, or slightly larger than a thickness of the flange 112. As such, with the anchor 110 engaged with the bracket 150, a rear surface of the flange 112 can align with a rear surface of the bracket 150.

In an embodiment, a rear surface of the base 152 can further include a socket 158 configured to receive the block portion 130 of the anchor 110 therein. As such, the socket 158 can define a similar shape matching that of the outer perimeter 134 of the block portion 130, e.g. a substantially rectangular shape. A width and height of the socket 158 can be equal to or slightly larger than the first width (w1) and first height (h1) of the block portion 130, respectively, such that the block portion 130 can slidably engage the socket 158 along the longitudinal axis. Similarly, a depth of the socket 158, extending over the longitudinal axis, can be equal to, or slightly larger than a second thickness (t2) of the block portion 130. As such, the block portion 130 can fit securely within the socket 158 with little to no space therebetween. Advantageously, the shape of the block portion 130 and the corresponding shape of the socket 158 can prevent rotational movement of the bracket 150, relative to the anchor 110, about the longitudinal axis. Similarly, a depth of the socket 158 relative to the second thickness (t2) of the block portion 130 can mitigate rotational movement of the bracket 130, relative to the anchor 110, through the longitudinal plane.

In an embodiment, the outer perimeter 154 of the base 152 can extend over the longitudinal axis by a second length (L2) to define a side wall. In an embodiment, the base 152 can include a bolt hole 170 extending along an axis perpendicular to the longitudinal axis and configured to align with the bolt hole 132 of the block portion 130. As shown, the bolt hole(s) 132, 170 extend along the transverse axis, however, it will be appreciated that the bolt holes 132, 170 can extend along a lateral axis, or along an axis extending at an angle there between. An axis 72 of the bolt hole 170 of the bracket 150 can extend through a longitudinal mid-point of the socket 158 and can align with the bolt hole 132 of the block portion 130 when the anchor 110 is engaged with the bracket 150. The bracket bolt hole 170 can extend from an entrance disposed on the outer perimeter 154 of the base 152, through the socket 158 to a point that is on an opposite side of the socket 158 from the entrance. A diameter of the bolt hole 170 can be equal to or slightly larger than a diameter of a shaft of a bolt 64 and can include a threaded portion 172. The threaded portion 172 can be disposed at an opposite end of the bolt hole 170 from the entrance and configured to engage a threaded portion of the bolt 64.

In an embodiment, an entrance of the bolt hole 170 can communicate with the outer perimeter 154 of the base 152 and can include a countersunk portion that defines a diameter that is equal to or larger than a bolt head of the bolt 64 to receive the bolt head therein. In an embodiment, the bracket bolt hole 170 can extend from an entrance at a bottom surface and can extend vertically upwards through the socket 158 to a threaded portion 172 disposed in a top surface of the socket 158. In an embodiment, an entire length of the bolt hole 170 can be threaded. When the block portion 130 is fully engaged with the socket 158, the bolt hole 132 of the block portion 130 can align with the bolt hole 170 of the bracket 150. The bolt 64 can then extend through both the anchor bolt hole 132 and the bracket bolt hole 170 to secure the bracket to the anchor 110 in a threaded engagement. As noted, the bolt 64 can interlock between the anchor-screws 116 to provide improved strength.

In an embodiment, as shown in FIGS. 4A-4D, the system 100 can further include an installation jig system ("jig") 200 configured to align a first bracket system 100A with a second bracket system 100B. The jig 200 can include a first footing 210A and a second footing 210B. Each of the first footing 210A and the second footing 210B can slidably engage one or more bars 290, e.g. a first bar 290A and a second bar 290B. In an embodiment, the bar 290 can include an abutment 292 disposed at an end of the bar 290. In an embodiment, the abutment 292 can be formed integrally with the bar 290. In an embodiment, the abutment 292 can releasably engage the bar 290 in a friction fit, snap fit, threaded engagement, or similar suitable attachment mechanism. The abutment 292 can be configured to prevent the footing 210 from disengaging the bar 290.

In an embodiment, the footing 210 can include a body 212 extending over a frontal plane and defining a front surface and a rear surface. The body 212 can include a block portion aperture 214. A width and height of the block portion aperture 214 can be equal to or slightly larger than the first width (w1) and first height (h1) of the block portion 130, respectively, such that the block portion 130 can slidably engage the block portion aperture 214. Similarly, a depth of the block portion aperture 214, extending over the longitudinal axis, can be equal to, or slightly smaller than a second thickness (t2) of the block portion 130. As such, the block portion 130 can fit securely within the block portion aperture 214 with little to no space therebetween and can extend through the body 212 between a rear surface and a front surface of the footing 210.

In an embodiment, the footing 212 can further include one or more support screw slots 218. The support screw slot 218 can extend through the body 212 between the front surface and the rear surface and can extend along a lateral axis. The support screw slot 218 can align with a support screw-hole 118 of the anchor 110 when the block portion 130 is engaged with the block portion aperture 214.

Figure 4A:
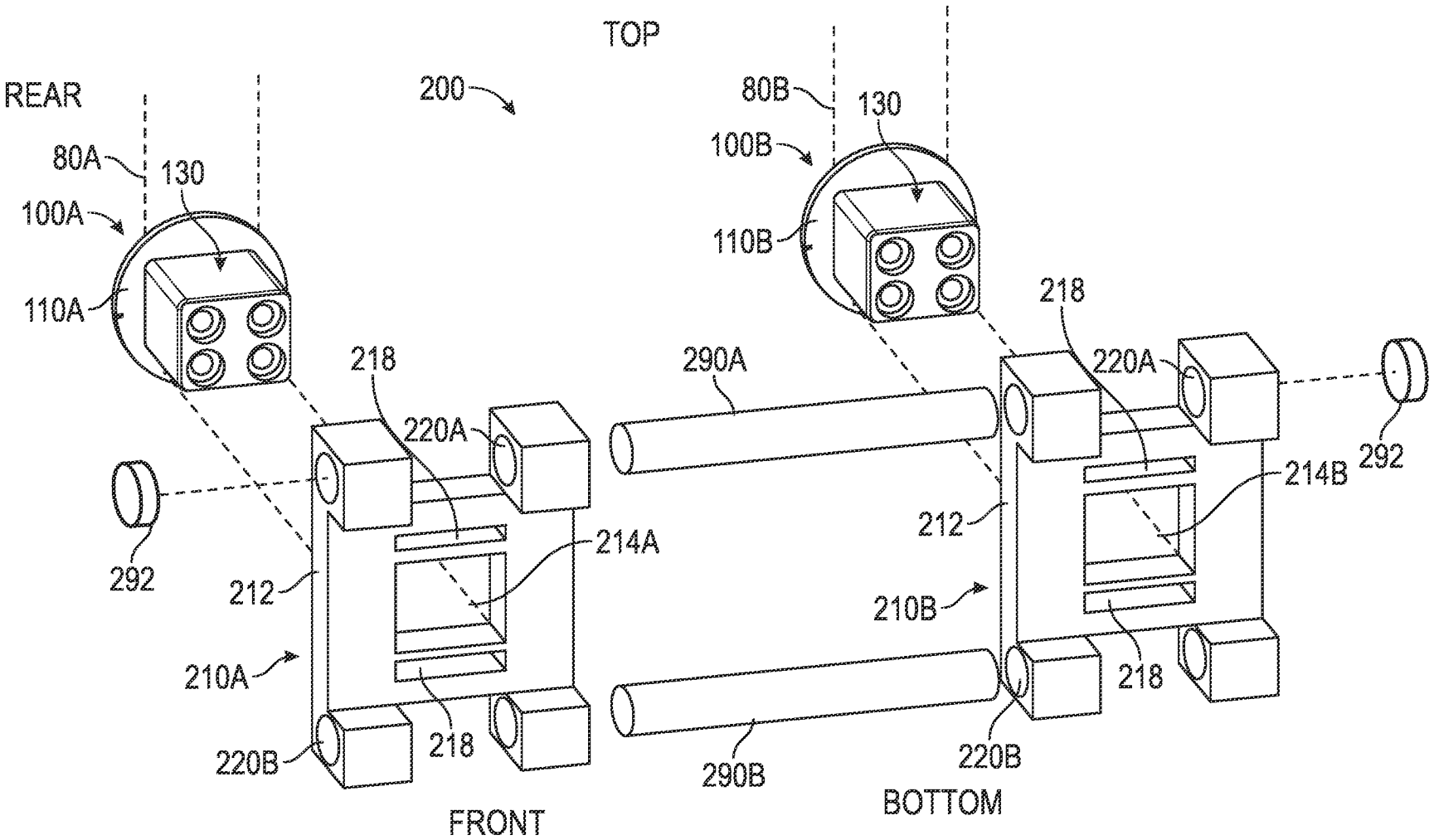
FIG. 4A shows an exploded view of a bracket and jig system, in accordance with embodiments disclosed herein.

In an embodiment, the footing 210 can further include one or more channels 220 extending along a lateral axis. An inner diameter of the channel 220 can be equal to or slightly larger than an outer diameter of the bar 290. As such, the bar 290 can slidably engage the channel 220 of the footing 210. As shown in FIG. 4A, each footing 210 can include a top channel 220A and a bottom channel 220B. The top channel 220A can be configured to receive a portion of the first bar 290A and the bottom channel 220B can be configured to receive a portion of the second bar 290B. The channel 220 can slidably engage the bar 290 to align the first footing 210A with a second footing 210B along a lateral axis. More specifically, the channel 220 can slidably engage the bar 290 to align the first block portion aperture 214A of the first footing 210A with a first block portion aperture 214B of the second footing 210B along a lateral axis. Further the lateral distance between the first block portion aperture 214A and the second block portion aperture 214B can be modified as needed. In an embodiment, a lateral length of the bar 290 can be between 10 inch. and 36 inch. In an embodiment, a lateral length of the bar 290 can be 24 inch. However, it will be appreciated that greater or lesser lateral lengths of the bar 290 are also contemplated. As noted, the bar 290 can include an abutment 292 disposed at an end of the bar 290 can abut against the footing 210 to prevent the footing 210 from disengaging the bar 290.

In an embodiment, the bracket system 100, or portions thereof such as the anchor 110, bracket 150, rod 190, jig system 200, or combinations thereof, can be formed from one or more materials. Exemplary materials can include plastics, polymers, metals, alloys, composites, or the like. In an embodiment, the bracket system 100, or portions thereof, can be formed from a single monolithic piece. In an embodiment, the bracket system 100, or portions thereof, can be formed from injection molding or similar molding techniques. In an embodiment, the bracket system 100, or portions thereof, can be formed from 3D printing, or similar additive manufacturing techniques. In an embodiment, the bracket system 100, or portions thereof, can be formed as a hollow, partially hollow, lattice structure, "honeycomb" structure, or the like.

In an exemplary method of use, a bracket system 100 including one or more of an anchor 110, a bracket 150, a rod 190 and a jig system 200 are provided, as described herein. In an embodiment, a user can align the anchor 110 with a rear surface of the anchor 110 engaging a front surface of the wall 98, i.e. a front surface of an exterior layer 90 of the wall 98, e.g. a dry wall layer. More specifically, the rear surface of the anchor 110 can be defined by a stud engaging surface 126 of the stud portion 120. A user can identify a position of the support beam 80 behind the exterior layer 90 using a "stud finder" or similar suitable device. The user can then align a center point of the stud engaging surface 126 with a central vertical (transverse) axis of the support beam 80.

As shown, the stud engaging surface 126 can define a substantially circular cross-sectional shape. In an embodiment, the stud engaging surface 126 can include a spike 122 extending from a center point of the circular, stud engaging surface 126. The user can align the spike 122 with a central vertical axis of the support beam 80 to center the circular stud engaging surface 126 with the support beam 80 along a lateral axis. Alternatively, or in addition to, a user can mark the lateral outer edges of the support beam 80 using a stud finder, or similar suitable means, and can center the lateral outer most edges of the stud engaging surface 126 therebetween along the lateral axis. As such, the spike 122 can align with a central vertical axis of the support beam 70. With the spike 122 aligned as such, a user can press the anchor 110 against the exterior layer 90 of the wall 98, or tap the front surface of the anchor 110 with a hammer or the like, and the spike 122 can form a dent within the wall surface indicating a center point of the stud engaging surface 126. The user can then use the dent formed by the spike 122 as an indicator of where to align a hole saw, spade bit, or similar device configured to cut a hole through the exterior layer at the same diameter, or slightly larger than the second diameter (d2) of the stud portion 120.

In an embodiment, the stud engaging surface 126 can include a continuous or discontinuous rim (not shown), extending longitudinally along an outer edge of the stud engaging surface 126. The rim can extend from the stud engaging surface 126 by a similar longitudinal distance as the spike 122. When the user taps or presses the anchor 110 into wall surface, the rim can indicate to a user an outer perimeter of the hole that is to be cut into the wall exterior layer 90.

With the hole cut in the exterior layer 90, the support beam 80 behind the exterior layer can be exposed. The user can then slide the stud portion 120 of the anchor 110 through the hole in the exterior layer 90 so that the stud engaging surface 126 contacts the surface of the support beam 80 directly. Alternatively, or in addition to, the user can slide the stud portion 120 of the anchor 110 through the hole so that the rear surface of the flange 112 engages a front surface of the wall 98, i.e. a front surface of the exterior layer 90. Advantageously, the hole cut within the exterior layer 90 can be sized to slidably engage the first portion 110 in an interference fit and can hold the anchor 110 in place when engaged therewith.

Advantageously, the circular shape of the stud portion 120 allows the user to rotate the anchor 110 about the longitudinal axis until the vertical axis of the anchor 110 is correctly aligned, e.g. the vertical axis of the anchor 110 is aligned with the vertical axis of the support beam 80, or a plumb line, spirit level, etc. Worded differently, the anchor 110 can be rotated about the longitudinal axis until a top surface of the block portion 130 is aligned with a horizontal axis, e.g. using a spirit level or the like.

Once the anchor 110 is correctly aligned a user can secure the anchor 110 in place by placing a screw through one or more of the support screw-hole(s) 118 and secure the anchor 110 in place, ensuring the anchor 110 does not further rotate about the longitudinal axis once correctly aligned. To note, the screws placed through the support screw-hole(s) 118 can be relatively shorter and/or thinner, relative to the anchor screw 60. A user can then place an anchor screw 60 through each of the anchor screw-holes 116 to secure the anchor 110 directly to the support beam 80. As shown, the anchor 110 includes four anchor screw-holes 116 and as such the user can place four anchor screws 60, one through each anchor screw-hole 116 to secure the anchor 110 directly to the support beam 80. However, it will be appreciated that greater or lesser numbers of anchor screws 60 can be used. The screw head 62 of the anchor screw 60 can abut against a front surface of the anchor 110 compressing the anchor 110 onto the support beam 80 securing the anchor 110 thereto. In an embodiment, the screw head 62 can be received within a countersunk portion 138 of the front surface of the anchor 110. Optionally, the support screw can then be removed.

In an embodiment, the bracket 150 can then slidably engage the anchor 110. The block portion 130 can slidably engage the socket 158 until the bolt hole 132 of the block portion 130 aligns with the bolt hole 170 of the bracket 150. The user can then slide a bolt 64 through the entrance of the bolt hole 170, through the bolt hole 132 of the block portion 130 and threadably engage a threaded portion 172 of the bolt hole 170 disposed on an opposite side of the socket 158. In an embodiment, the flange 122 can be received within the flange recess 156 such that a rear-most surface of the base 152 of the bracket 150 can engage a surface of the wall 98.

Advantageously, the stud engaging surface 126 of the anchor 110 can extend through the exterior layer 90 to engage a surface of the support beam 80 and mitigate movement of the anchor 110 through either a longitudinal plane, horizontal plane, or a plane extending at an angle therebetween. Further, the flange 112 can engage the front surface of the exterior layer 90 to further stabilize the anchor 110 and mitigate longitudinal or horizontal planar movement.

By contrast, bracket systems or similar fastening systems that rest on a front surface of the exterior layer 90 of the wall 98 and include anchor screws extending through the exterior layer 90, and optionally through to the support beam 80, are relatively more susceptible to longitudinal or horizontal planar movement. Such bracket systems are supported away from the support beam 80 by the distance of the exterior layer 90. The compression strength of the exterior layer 90 can be less than that of the support beam 80. As such, the bracket system can be forcibly rotated through the longitudinal or horizontal plane and crush or dent the exterior layer 90 between the bracket and the support beam 80, leading to failure of the bracket system.

Figure 4C:
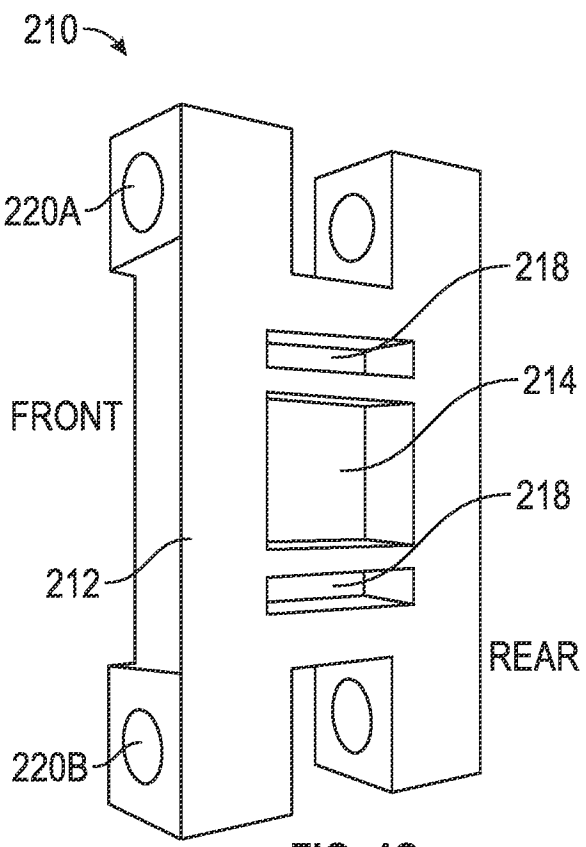
FIG. 4C shows a perspective rear view of a bracket, in accordance with embodiments disclosed herein.
Figure 4B:
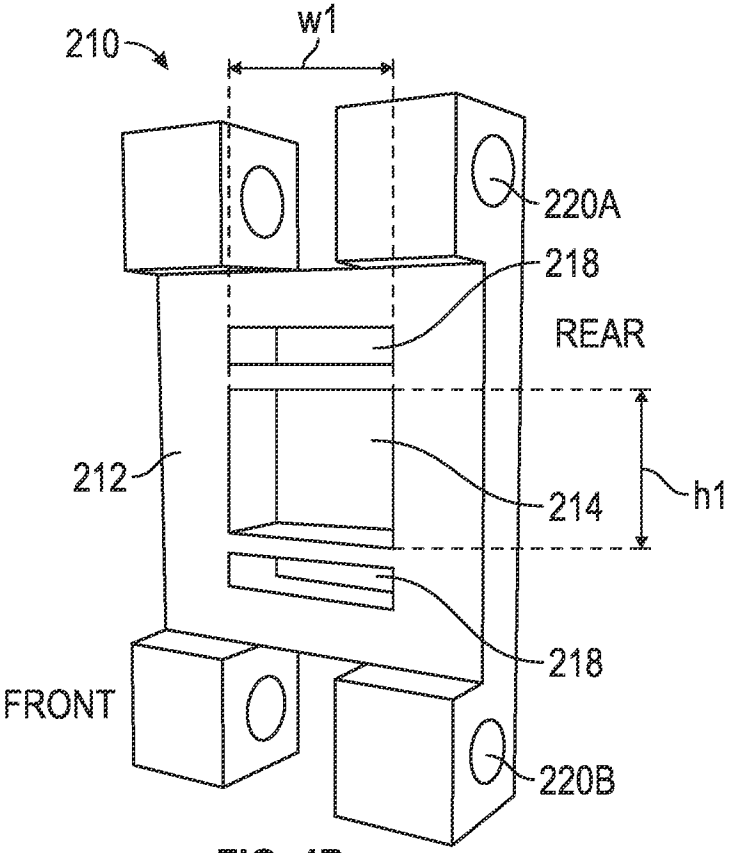
FIG. 4B shows a perspective front view of a bracket, in accordance with embodiments disclosed herein.
Figure 4D:
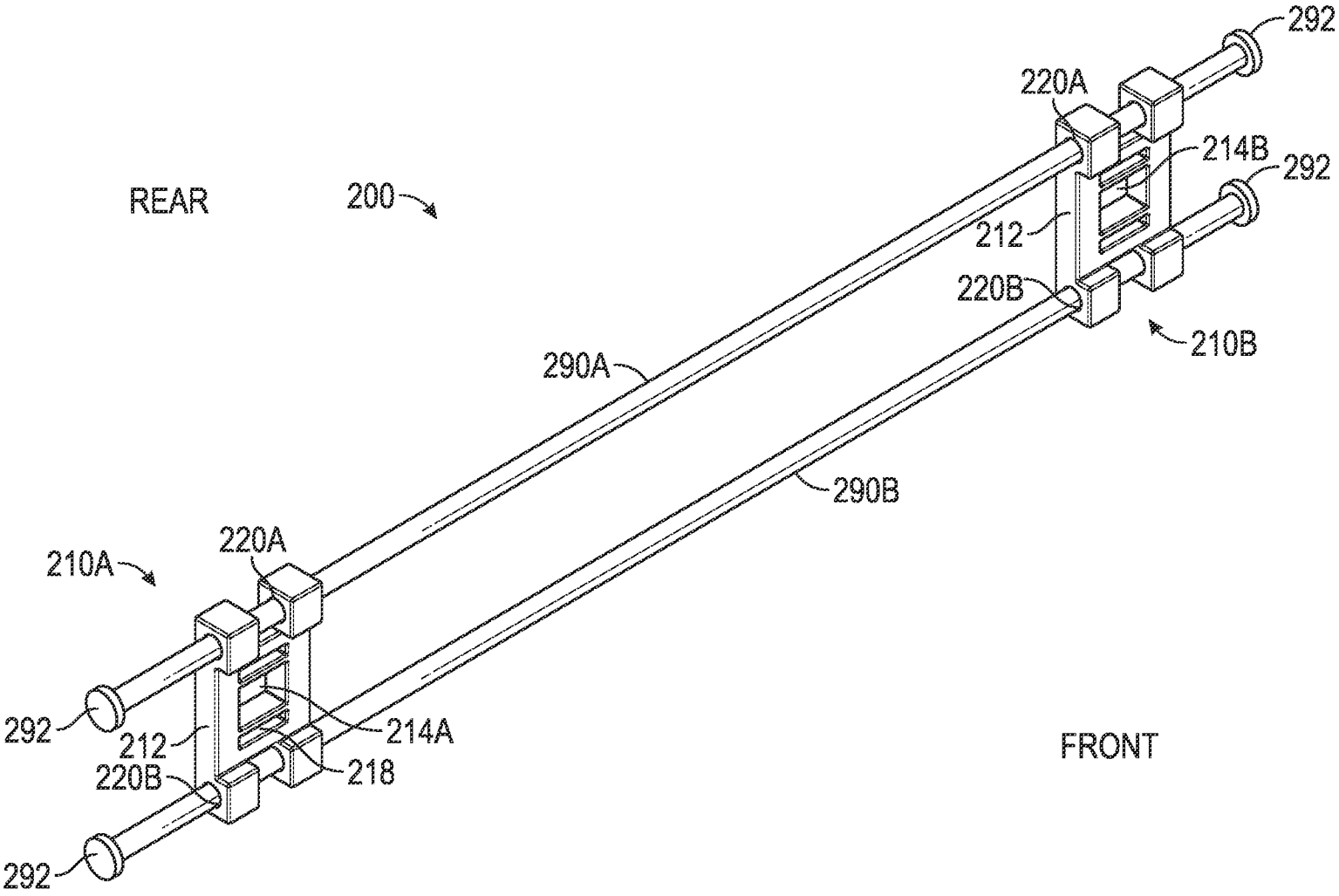
FIG. 4D shows an assembled view of the jig system of FIG. 4A, in accordance with embodiments disclosed herein.

In an embodiment, two or more bracket systems 100 can be used to attach structures to a wall surface 98. Exemplary structures can include towel rods 190, guide rails, hand rails, shelving supports, picture hangers, TV mounts, exercise equipment, pull up bars, shower curtain rods, drapes, or the like. As such, aligning the anchors 110 of the two or more bracket system 100 can be important to ensure the alignment of a first retaining structure 162A with that of a second retaining structure 162B. As shown in FIGS. 4A-4C a jig system 200 can be used to ensure correct alignment.

In an exemplary method of use, a first anchor 110A can be secured through a wall exterior layer 90 and engage a first support beam 90A, as described herein. The anchor 110 can be rotated about the longitudinal axis until a vertical axis and/or a horizontal axis of the anchor 110 is correctly aligned, e.g. using a plumb line, spirit level, or the like. In an embodiment, prior to securing the anchor 110 using the support screw or the anchor screw 60, a first footing 210 of the jig 200 can engage the anchor 110 by slidably engaging the block portion 130 with the block portion aperture 214. Advantageously, the footing 210 can provide a larger surface area with which to support a spirit level device and provide leverage to accurately align the anchor 110. Once the anchor 110 and footing 210 assembly is correctly aligned a support screw can be advanced through the support screw slot 218 of the footing 210, through the support screw-hole 118 and engage the exterior layer of the wall 98 to secure the anchor 110 in place. Alternatively, or in addition to, an anchor screw 60 can be advanced through an anchor screw hole 116 to secure the first anchor 110A to the first support beam 80A.

In an embodiment, a first end of the first support bar 290A can engage the top channel 220A of the first footing 210A and a second end of the first support bar 290A, opposite the first end, can engage the top channel 220A of the second footing 210B. Similarly, a first end of the second support bar 290B can engage the bottom channel 220B of the first footing 210A, and a second end of the second support bar 290B, opposite the first end, can engage the bottom channel 220B of the second footing 210B. A block portion 130 of a second anchor 110B can then engage a block portion aperture 214B of the second footing 210B. The user can then slide the second anchor 110B and the second footing 210B assembly along a lateral axis until the spike 122 of the second anchor 110B is aligned with a central transverse axis of a second support beam 80B. An abutment 292 can prevent the second footing 210B from disengaging the bar 290.

Advantageously, the jig system 200 can quickly and accurately align the second bracket system 100B with a second support beam 80B while maintaining the second bracket system 100B along the same lateral axis as the first bracket system 100A. The user can then mark the location of the second anchor 110B, cut the hole through the exterior layer 90 and secure the second anchor 110B directly to the second support beam 80B, as described herein. A first bracket can be coupled to the first anchor 110A and a second bracket can be coupled to the second anchor 110B as described herein. A first end of a rod 190 can be engaged with the retainment structure of the first bracket and a second end of the rod 190, opposite the first end, can engage the retainment structure of the second bracket to provide a towel rail or the like. In an embodiment the bracket system 100 can support significantly greater loads, for example, loads of 600 lbs. or more depending on the configuration of anchor screws 60, supporting beams, and the like. Advantageously, a towel rail using the bracket system 100 can mitigate damage to the wall due to accidental overloading of the bracket system 100.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A bracket system for coupling to a wall having an exterior layer and a support beam, the bracket system comprising:

an anchor, comprising:

a flange extending over a frontal plane, parallel with a surface of the wall and defining a front surface and a rear surface;

a stud portion extending from the rear surface of the flange and defining a stud-engaging surface configured to extend through the exterior layer and engage the support beam;

a block portion extending from the front surface of the flange;

an anchor screw hole extending longitudinally between a front surface of the anchor and the stud-engaging surface; and a bolt hole extending transversely between a plane defined by a front end of the anchor screw hole and a plane defined by the stud-engaging surface; and a bracket comprising a base defining a socket configured to slidably engage the block portion and secured thereto.

2. The bracket system according to claim 1, wherein the anchor screw hole further includes a countersunk portion communicating with the front surface of the anchor.

3. The bracket system according to claim 2, wherein the bolt hole extends transversely through a portion of the bracket and through the block portion, the bolt hole extending between a plane defined by the countersunk portion and the plane defined by the stud-engaging surface.

4. The bracket system according to claim 1, wherein the bracket further includes a post extending along a longitudinal axis and including a retaining structure disposed at a front end of the post, the retaining structure defining a recess extending along a lateral axis.

5. The bracket system according to claim 4, wherein the recess is configured to receive a portion of a towel rod therein.

6. The bracket system according to claim 1, wherein a rear surface of the base includes a flange recess defining a diameter and a thickness equal to, or slightly larger than, a flange diameter and thickness, respectively, and configured to slidably engage the flange when the bracket is engaged with the anchor.

7. The bracket system according to claim 1, wherein the block portion defines a rectangular cross-sectional shape along a frontal plane, and the stud portion defines a circular cross-sectional shape along the frontal plane.

8. The bracket system according to claim 1, further including one or both of a spike structure and a rim, the spike structure extending rearwards from a center point of the stud-engaging surface, and the rim extending rearwards from a perimeter of the stud-engaging surface, each of the spike structure and the rim configured to indent a front surface of the wall.

9. The bracket system according to claim 1, further including a jig system, comprising one or more footings having a body defining a block portion aperture and a channel, the block portion aperture extending longitudinally and configured to slidably engage the block portion of the anchor, and the channel extending along a lateral axis.

10. The bracket system according to claim 9, further including a bar defining an outer diameter that is equal to, or slightly smaller than, an inner diameter of the channel of a footing of the one or more footings, and configured to slidably engage the channel.

11. The bracket system according to claim 10, wherein the footing further includes a support screw slot extending longitudinally and configured to align with a support screw aperture extending through the flange when the block portion is engaged with the block portion aperture of the footing.

12. A method of attaching a bracket system to a wall having an exterior layer supported by a support beam, the method comprising:

extending a stud portion of an anchor through the exterior layer to contact the support beam;

extending an anchor screw through the anchor to secure the anchor to the support beam;

slidably engaging a socket of a bracket with a block portion of the anchor; and threadably engaging a bolt through a portion of a base of the bracket and through the block portion of the anchor between a plane defined by an anchor screw head and a surface of the support beam.

13. The method according to claim 12, wherein the anchor further includes a flange extending along a frontal plane between the stud portion and the block portion, a rear surface of the flange engaging a front surface of the exterior layer of the wall.

14. The method according to claim 13, further including aligning a transverse axis of the anchor with a vertical axis and securing the anchor in place using a support screw extending through the flange.

15. The method according to claim 12, wherein the stud portion defines a circular cross-sectional shape and the block portion defines a rectangular cross-sectional shape.

16. The method according to claim 12, further including aligning a stud-engaging surface of the stud portion with a front surface of the exterior layer and with a vertical center line of the support beam, and pressing the anchor against the exterior layer, and indenting the exterior layer using one or both of a spike and a rim extending from the stud-engaging surface to indicate a position to form a hole through which the stud portion extends to contact the support beam.

17. The method according to claim 12, further including:

engaging a first footing of a jig system with the block portion of a first anchor;

engaging a block portion of a second anchor with a second footing;

slidably engaging the first footing and the second footing with a bar;

sliding the second footing relative to the first footing along a lateral axis; and aligning the second anchor with a second support beam.

18. The method according to claim 17, wherein one or both of the first footing and the second footing includes a block portion aperture extending between a front surface and a rear surface and slidably engaging the block portion.

19. The method according to claim 17, further including securing the first footing to the first anchor by extending a support screw through a support screw slot and through a support screw aperture disposed in a flange of the anchor.

20. The method according to claim 17, further including engaging a rod between a retaining structure of a first bracket configured to engage the first anchor, and a retaining structure of a second bracket configured to engage the second anchor to form a towel rail, once the jig system has been removed from the first anchor and the second anchor.

* * * * *